US005837666A

United States Patent [19]

Murata et al.

[11] Patent Number: 5,837,666

[45] Date of Patent: Nov. 17, 1998

[54] DETERGENT COMPOSITIONS COMPRISING METHYL CELLULOSE ETHER

[75] Inventors: Susumu Murata, Amagasaki; David Johnathan Kitko, Nishinomiya; Kiyomi Shimamura, Higashisumiyoshi-ku; Allen David Clauss, Higashinada, all of Japan

[73] Assignee: The Procter & Gamble Company, Cincinnati, Ohio

[21] Appl. No.: 765,851

[22] PCT Filed: Jun. 19, 1995

[86] PCT No.: PCT/US95/07785

§ 371 Date: Dec. 16, 1996

§ 102(e) Date: Dec. 16, 1996

[87] PCT Pub. No.: WO96/00770

PCT Pub. Date: Jan. 11, 1996

[30] Foreign Application Priority Data

Jun. 30, 1994 [JP] Japan ..... 6-148881

[51] Int. Cl.[6] ..... C11D 3/22; C11D 3/395; C11D 3/60

[52] U.S. Cl. ..... 510/299; 8/137; 510/300; 510/302; 510/350; 510/351; 510/352; 510/470; 510/473; 510/496; 510/497; 510/498

[58] Field of Search ..... 510/470, 473, 510/299, 350, 351, 352, 504, 496, 497, 498, 300, 302; 8/137

[56] References Cited

U.S. PATENT DOCUMENTS

| | | | |
|---|---|---|---|
| 2,994,665 | 8/1961 | Reich et al. | 510/337 |
| 3,668,000 | 6/1972 | Forschirm et al. | 427/445 |
| 4,100,094 | 7/1978 | Burns et al. | 252/89 R |
| 4,136,038 | 1/1979 | Pracht et al. | 252/8.8 |
| 4,174,305 | 11/1979 | Burns et al. | 252/545 |
| 4,532,067 | 7/1985 | Padron et al. | 510/424 |
| 4,564,463 | 1/1986 | Secemski et al. | 510/299 |
| 4,566,993 | 1/1986 | Secemski et al. | 252/559 |
| 4,876,034 | 10/1989 | Hirota et al. | 510/405 |

*Primary Examiner*—Ardith Hertzog
*Attorney, Agent, or Firm*—Brian M. Bolam; Kim William Zerby; Jacobus C. Rasser

[57] ABSTRACT

Detergent compositions comprise from 0.05 to 2 percent by weight of methyl cellulose ether having a solution viscosity measured at a temperature of 20° C. as a 2 wt % aqueous solution of from 80 to 120 centipoise and an average degree of methyl substitution per anhydroglucose of from about 1.6 to about 2.3, from 25 to 65 percent by weight of detergent surfactant, from 0 to 20 percent by weight of bleaching component, and from 30 to 70 percent by weight of builder and alkaline material. The compositions may be used in a method of washing polyester fabric in cold water.

20 Claims, No Drawings

DETERGENT COMPOSITIONS COMPRISING METHYL CELLULOSE ETHER

BACKGROUND OF THE INVENTION

This invention relates to a detergent composition containing a methyl cellulose ether for effectively releasing both muddy soil (particulate soil) and oily soil deposited on polyester fibers in water at not more than 30 degree C.

Methyl cellulose ethers or detergent compositions or conditioning compositions containing the methyl cellulose ethers are disclosed in U.S. Pat. Nos. 4,000,093; 4,048,433; 4,100,094; 4,136,038; 4,564,463; 4,441,881; and 4,770,666; British Patent No. 1,498,520 and Japanese Patent Laid-Open Publication No. 142007/1976. It is known that the methyl cellulose ethers have a soil release effect. When soiled polyester fibers are washed in washing water not more than 30 degree C., high molecular weight methyl cellulose ethers release well oily soil. However, such high molecular weight methyl cellulose ethers insufficiently release muddy soil. On the other hand, low molecular weight methyl cellulose ethers can release muddy soil. However, such low molecular weight methyl cellulose ethers insufficiently release oily soil.

The present invention relates to a detergent composition containing a methyl cellulose ether having a particular viscosity and a particular degree of methyl alkyl substitution (DS methyl) by which both oily soil and muddy soil deposited on polyester fibers are selectively very well released in washing water at not more than 30 degree C. at the same time and thus the composition has an excellent polyester fiber detergency.

SUMMARY OF THE INVENTION

That is, the present invention relates to a detergent composition for use in washing of polyester fibers comprising (i) from 0.05 to 2% by weight of a methyl cellulose ether wherein its solution viscosity measured at a temperature of 20 degree C. as a 2 wt % aqueous solution is from 80 to 120 centipoises (cps) and its average degree of methyl substitution (DS methyl) per anhydroglucose is from about 1.6 to about 2.3;

(ii) from 25 to 65% by weight of a detergent surfactant;

(iii) from 0 to 20% by weight of a bleaching component; and (iv) from 30 to 70% by weight of a builder and an alkaline material.

DETAILED DESCRIPTION OF THE INVENTION

The methyl cellulose ether described above preferably is represented by the following formula:

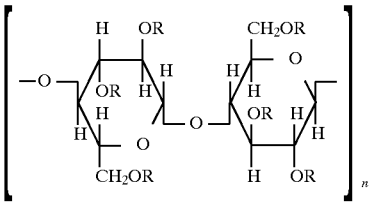

wherein R represent a hydrogen atom or a methyl group, respective R may be the same or different; n represents a degree of polymerization wherein n is a value such that its solution viscosity measured at a temperature of 20 degree C. as a 2 wt% aqueous solution is from 80 to 120 centipoises (cps).

The methyl cellulose ethers used in the present invention are those wherein the solution viscosity measured at a temperature of 20 degree C. as a 2 wt % aqueous solution is from 80 to 120 centipoises (cps), preferably from 90 to 110 centipoises (cps) and the average degree of methyl substitution (DS methyl) per anhydroglucose is from about 1.6 to about 2.3, preferably from about 1.7 to about 1.9, more preferably about 1.8. Such methyl cellulose ethers are available, for example, as Metolose SM 100 (manufactured by Shin-etsu Kagaku Kogyo K.K.).

If the solution viscosity is less than 80 cps, then it will be difficult to release oily soil. If the solution viscosity is more than 120 cps, then it will be difficult to release muddy soil.

If the average degree of methyl substitution is less than about 1.6, then it will be difficult to dissolve the methyl cellulose ether in water and an organic solvent such as a surfactant, and it will be difficult to release muddy soil. If the average degree of methyl substitution is more than about 2.3, then it will be difficult to dissolve the methyl cellulose ethers in water.

When the viscosity is converted to molecular weight by a method described in Polymer Paper Vol. 39, No. 4, pp. 293–298 (April, 1982), the methyl cellulose ethers having a solution viscosity measured at 20 degree C. as a 2 wt % aqueous solution of from 80 to 120 centipoises (cps), preferably from 90 to 110 centipoises (cps) approximately correspond to methyl cellulose ethers having a molecular weight of from about 100,000 to about 150,000, preferably about 110,000 to about 140,000.

The solubility of the methyl cellulose ethers described above is reduced at a temperature higher than 30 degree C. and therefore it is desirable that the detergent compositions of the present invention be used in washing water at a temperature of not more than 30 degree C.

The detergent surfactant of the present invention is selected from anionic surfactants, nonionic surfactants, cationic surfactants, amphoteric surfactants and mixture thereof. The anionic surfactant can include secondary $C_{10}$–$C_{18}$ alcohol sulfates, straight-chain $C_{10}$–$C_{18}$ alkylbenzene sulfonates, alkyl sulfates, and alkylethoxy sulfates, -sulfofatty acid ester salts, fatty acid salts (soap) and olefinsulfonates. The nonionic surfactant can include $C_{10}$–$C_{16}$ alcohol ethoxylates comprising an alcohol having ethylene oxide added thereto, nonylphenol ethoxylates, adducts comprising an alcohol having propylene oxide and ethylene oxide added thereto, fatty acid alkanolamides, sucrose fatty acid esters, alkylamine oxides and polyhydroxy-fatty acid amides. The detergent surfactant of the present invention also can be selected from description of W09218594 which is incorporated herein by reference.

It is desirable that the detergent surfactant of the present invention is a mixture of an anionic surfactant and a nonionic surfactant in a weight ratio of the anionic surfactant to the nonionic surfactant of from 50:50 to 95:5. It is more desirable that said anionic surfactant is a mixture of a straight-chain alkylbenzene sulfonate and an alkyl sulfate in a weight ratio of the alkylbenzene sulfonate to the alkyl sulfate of from 1:99 to 80:20. Further, it is desirable that the detergent surfactant of the present invention be a mixture of an anionic surfactant, a nonionic surfactant and a cationic surfactant wherein the content of the cationic surfactant in the mixture is not more than 5% by weight.

The bleaching component can be optionally be used in the detergent composition of the present invention. The bleaching component can be a source of $^{-}$OOH group, such as sodium perborate monohydrate, sodium perborate tetrahydrate and sodium percarbonate. Sodium percarbonate ($2Na_2CO_3 3H_2O_2$) is preferred since it has a dual function of both a source of HOOH and a source of sodium carbonate. Another useful bleaching component is a bleaching precursor, for example, nonanoyloxybenzene sulfonate represented by the formula:

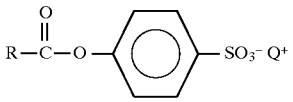

wherein R represents a linear or branched alkyl chain having approximately from 5 to 12 carbon atoms, preferably approximately from 6 to 9 carbon atoms, and preferably at least one alkyl group is bonded to the second or third carbon atom counting from carbonyl group; and Q represents sodium or potassium. The bleaching precursor is used in combination with a source of $^{-}$OOH group such as sodium perborate monohydrate, sodium perborate tetrahydrate and sodium percarbonate to form a peracid in the wash solution.

Another bleaching component is a peracid per se, such as the formula:

$$CH_3(CH_2)_w—NH—CO—(CH_2)_zCO_3H$$

wherein z is from 2 to 4 and w is from 4 to 10. (The compound of the latter formula where z is 4 and w is 8 is hereinafter referred to as NAPAA.) The bleaching component can contain, as a bleaching component stabilizer, a chelating agent of polyaminocarboxylic acids or polyaminocarboxylates such as ethylenediamino-tetraacetic acid, diethylenetriamino-pentaacetic acid and ethylenediamino-disuccinic acid and their salts with water-soluble alkali metals.

Builders and alkaline materials which can be used in the detergent composition of the present invention are, for example, crystalline layered sodium silicate, a phosphate and non-phosphate calcium ion sequestering builder, a dispersing agent and an alkaline builder.

The crystalline layered sodium silicate preferably has a composition represented by the following formula:

$$NaMSi_xO_{2x+1}yH_2O$$

wherein M represents sodium or hydrogen; x is from 1.9 to 4; and y is from 0 to 20.

Such a crystalline layered sodium silicate is described in Japanese Patent Laid-Open Publication Nos. 227895/1985 and 178398/1990. It is available, for example, as SKS-6 (manufactured by Hoechst AG) having the chemical formula of $Na_2Si_2O_5$. The phosphate calcium ion sequestering builder can include sodium tripoly phosphate and sodium pyrophosphate as well as organic phosphonates and aminoalkylene poly (alkylene phosphonates). Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorus compounds in the compositions is desired. The non-phosphate calcium ion sequestering builder can include alkali metal aluminosilicates, monomeric polycarboxylates, homo or copolymeric polycarboxylic acids or their salts in which the polycarboxylic acid comprises at least two carboxylic radicals separated from each other by not more than two carbon atoms, carbonates, silicates, citric acid and mixtures of any of the foregoing. Whilst a range of aluminosilicate ion exchange materials can be used, preferred sodium aluminosilicate zeolites have the unit cell formula:

$$Na_t[(AlO_2)_r(SiO_2)_s]H_2O$$

wherein r and s are at least 6; the molar ratio of r to s is from 1.0 to 0.5 and t is at least 5, preferably from 7.5 to 276, more preferably from 10 to 264. The aluminosilicate materials are in hydrated form and are preferably crystalline, containing from 10% to 28%, more preferably from 18% to 22% water in bound form. The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/(gram/gallon)] of aluminosilicate (anhydrous basis), and which generally lies within the range of from 130 mg equivalent of $CaCO_3$/liter/minute/(gram/liter) [2 grains/gallon/minute/ (gram/gallon)] to 390 mg equivalent of $CaCO_3$/liter/minute/(gram/liter) [6 grains/gallon/minute/(gram/gallon)], based on calcium ion hardness. Optimum aluminosilicates for builder purposes exhibit a calcium ion exchange rate of at least 260 mg equivalent of $CaCO_3$/liter/minute/(gram/liter) [4 grains/gallon/minute/(gram/gallon)]. Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite X, Zeolite HS and mixtures thereof. In an especially preferred embodiment, the crystalline aluminosilicate ion exchange material is Zeolite A and has the formula:

$$Na_{12}[(AlO_2)_{12}(SiO_2)_{12}]xH_2O$$

wherein x is from 20 to 30, especially 27. Zeolite X of formula $Na_{86}[(AlO_2)_{86}(SiO_2)_{106}]276H_2O$ is also suitable, as well as Zeolite HS of formula $Na_6[(AlO_2)_6(SiO_2)_6]7.5H_2O$.

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5. The logarithmic acidity constant is defined by reference to the equilibrium:

$$H^+ + A \leftrightharpoons H^+$$

where A is the fully ionized carboxylate anion of the builder salt.

The equilibrium constant is therefore $$K_1 = \frac{(H^+A)}{(H^+)(A)}$$

and $pK_1 = \log_{10}K$.

For the purposes of this specification, acidity constants are defined at 25 degree C. and at zero ionic strength. Literature values are taken where possible (see Stability Constants of Metal-Ion Complexes, Special Publication No. 25, The Chemical Society, London); where doubt arises they are determined by potentiometric titration using a glass electrode.

Preferred carboxylates can also be defined in terms of their calcium ion stability constant ($pK_{Ca}$++) defined, analogously to $pK_1$, by the equations:

$$pK_{Ca}^{++} = \log_{10} K_{Ca}^{++}$$

$$\text{where } K_{Ca++} = \frac{(Ca^{++}A)}{(Ca^{++})(A)}$$

Preferably, the polycarboxylate has a $pK_{Ca}$++ in the range from about 2 to about 7, especially from about 3 to about 6. Once again, literature values of stability constant are taken where possible. The stability constant is defined at 25C and at zero ionic strength using a glass electrode method of measurement as described in Complexation in Analytical Chemistry by Anders Ringbom (1963). The carboxylate or polycarboxylate builder can be monomeric or oligomeric in type although monomeric polycarboxylates are generally preferred for reasons of cost and performance. Monomeric and oligomeric builders can be selected from acyclic, alicyclic, heterocyclic and aromatic carboxylates having the general formulae:

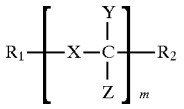
(a)

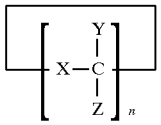
(b)

or

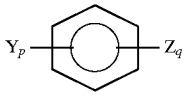
(c)

wherein $R_1$ represents H, $C_{1-30}$ alkyl or alkenyl optionally substituted by hydroxy, carboxy, sulfo or phosphono groups or attached to a polyethylenoxy moiety containing up to 20 ethylenoxy groups; $R_2$ represents H, $C_{1-4}$ alkyl, alkenyl or hydroxy alkyl, or alkaryl, sulfo, or phosphono groups; X represents a single bond; O; S; SO; $SO_2$; or $NR_1$; Y represents H; carboxy; hydroxy; carboxymethyloxy; or $C_{1-30}$ alkyl or alkenyl optionally substituted by hydroxy or carboxy groups; Z represents H; or carboxy; m is an integer from 1 to 10; n is an integer from 3 to 6; p, q are integers from 0 to 6, p+q being from 1 to 6; and wherein, X, Y, and Z each have the same or different representations when repeated in a given molecular formula, and wherein at least one Y or Z in a molecule contain a carboxyl group.

Suitable carboxylates containing one carboxy group include the water soluble salts of lactic acid, glycolic acid and other derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Alicyclic and heterocyclic polycarboxylates include cyclopentane-cis, cis, cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343. Of the above, the preferred polycarboxylates are hydroxycarboxylates containing up to three carboxy groups per molecule, more particularly citrates. The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention. Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000. These materials are normally used at levels of from 0.5% to 10% by weight, more preferably from 0.75% to 8%, most preferably from 1% to 6% by weight of the composition.

Suitable examples of other copolymeric polycarboxylic acids and salts thereof are acrylic acid-maleic acid copolymers or their salts represented by the following general formula (I):

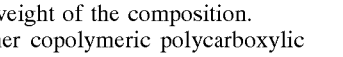
(I)

wherein the ratio of x:y is from 3:7 to 7:3; and M is a counter ion, preferably sodium or potassium. The molecular weight of these copolymers is from 5,000 to 15,000.

These copolymers can be produced, for example, by a method described in Japanese Patent Laid-Open Publication No. 4510/1977.

One example of the suitable polycarboxylate is shown by the following equation as described in Australian Application No. PM 6108. Examples of the polycarboxylates also include polycarboxylate builders having an IR value of not less than 100.

IR=BI(bond index) DI(dispersion index) 1/100

BI=(bond ability of sample/0.34) 100

DI=(dispersion ability of sample/2.5) 100

Method of Measuring Bond Ability of Sample:

The following reagents and polycarboxylate sample solutions are prepared.

[1] Glycine Buffer Solution 8.85 grams of glycine, 6.90 grams of sodium chloride and 80 ml of 1 N sodium hydroxide are mixed and the resulting mixture is diluted with deionized water to prepare 200 ml of a buffer solution.

[2] Calcium Solution 2.940 grams of calcium chloride dihydrate are diluted with deionized water to 200 ml (0.100 M).

[3] Diluted Buffer Solution 20 ml of the glycine buffer solution [1] is diluted with deionized water to one liter.

[4] Polycarboxylate Sample Solution

A sample of polycarboxylate is diluted with deionized water to prepare a 1% sample solution (as an active component). An ionmeter is provided as follows. A calcium ion selection electrode (Orion #93200) is adjusted according to the operating manual of manufacturer. The temperature of the diluted buffer solution [3] is set at 20 degree C. (plus minus 0.1 degree C.). An ionmeter (Orion Model 920 A) is equipped with a double junction reference electrode (Orion #90020) and an ion selection electrode. 50 ml of a modified solution is prepared by diluting 0.100 M calcium solution [2] with the diluted buffer solution [3]. 50 ml of 0.10 mM $Ca^{++}$, 0.20 mM $Ca^{++}$, 0.30 mM $Ca^{++}$, 0.40 mM $Ca^{++}$, and 0.50 mM $Ca^{++}$five calibration solutions are prepared. The calibration of the instruments is carried out in these five solutions. The samples are measured as follows. 10 grams of the polycarboxylate sample solutions [4] are added to 50 ml of the 0.50 mM $Ca^{++}$ modified solution and the resulting mixture is stirred by means of a magnetic stirrer (about 600 rpm). After 3 minutes, the calcium concentrations of the stirred solutions are recorded and the bond ability of the samples is calculated as follows: Bond Ability of Sample=0.5 mM—the calcium concentration after 3 minutes Method of Measuring Dispersion Ability of Sample:

The following reagents and polycarboxylate sample solutions are prepared.

[1] Glycine Buffer Solution 67.56 grams of glycine, 52.60 grams of sodium chloride and 60 ml of 1 N sodium hydroxide are mixed and the resulting mixture is diluted with deionized water to prepare 600 ml of a buffer solution. Thereafter, 60 grams of the glycine buffer solution described above are diluted with ion-exchanged water to prepare 1000 grams of a diluted buffer solution.

[2] Polycarboxylate Sample Solution

A sample of polycarboxylate is diluted with the diluted buffer solution described in [1] to prepare a buffer solution containing 50 ppm of active components.

One gram of soil (Kanto loam) is placed in a 100 cc standard test tube having a radius of 1.3 cm, 100 cc of the sample solution [2] is poured into the test tube, and the test tube is capped with a lid (or a paraffin film). The capped test tube is well shaken twenty times. The fact that no soil deposits at the bottom of the test tube is confirmed. The test tube is placed on a test tube stand and allowed to stand for 20 hours as it is. A photoelectrode is subjected to calibration as follows. The photoelectrode (DP 500) is connected to a titration device (Mettler DL 25). Ion-exchanged water is placed in a plastic cup, the photoelectrode is placed in water in the cup, and the contents are allowed to stand for 15 minutes to stabilize them. Thereafter, the electric potential of the titration device is adjusted at 1000 mV. The measurement of sample dispersion is carried out as follows:

The intermediate point (5.5 cm from the upper surface of the solution) of a supernatant in the test tube stood at the test tube stand is marked, and the photoelectrode is placed in the test tube and disposed at the situation of the marking. When the read value (output) in millivolt (mV) is stable, the read value in millivolt (mV) is recorded.

The dispersion ability is calculated as follows:

Dispersion Ability of Sample=−1 n (mV/1000)

The dispersion ability of 2.5 is used as a standard.

Of the polycarboxylate builders having such IR values of not less than 100, acrylic acid-maleic acid copolymers represented by the general formula (I) as described above are particularly preferred.

The dispersing agent can include acrylic acid-maleic acid copolymers, polyaspartic acid, polyacrylates and the like. The alkaline builder can include alkali metal silicates such as sodium silicate, alkali metal carbonates such as sodium carbonate, bicarbonates such as sodium hydrogencarbonate and the like. The dose of the detergent composition of the present invention should be from 15 grams to 45 grams, preferably from 20 grams to 30 grams, per 30 liters of washing water. The detergent composition of the present invention can optionally contain, in addition to the methyl cellulose ether, detergent surfactants, optional bleaching components and builders and alkaline materials, other additives such as a fluorescent brightening agent, a color migration inhibitor, a suds suppressor, enzymes such as protease, alkalase, cellulase and lipase, fabric softening agents such as clays and quaternary ammonium compounds and the like.

The detergent composition of the present invention may be prepared by the following method. The detergent surfactants, the builders, the alkaline materials, and the like are mixed to form a detergent slurry, and the detergent slurry is then dried to form a base granule. If necessary, compaction is carried out. Thereafter, the base granule is crushed and granulated. The nonionic surfactant is sprayed on to the granulated base granulate. In coating the base granule with zeolites or the like, the methyl cellulose ether can be added. Moisture- or heat-sensitive materials such as the bleaching component, the perfume, the enzyme, the crystalline layered sodium silicate, the color migration inhibitor and the suds suppressor are added to the base granule and they are mixed to obtain the detergent composition. Optionally, portions of the detergent surfactants and other builders and alkaline materials can be added as dry particles to the base granule, particularly when formulating a high density, compact detergent product. Also optionally, the dried base granule can be disintegrated into smaller particles and agglomerated or re-combined to form a dense, compact base granule. Examples of such methods of making dense, compact detergent products are described in Japanese Patent Laid-Open Publication Nos. 169900/1987, 161898/1987, 86700/1990 and 81500/1992 and WO 9206170 (The Procter & Gamble Company), Japanese Patent Laid-Open Publication No. 72999/1985 (Kao Sekken K.K.) and U.S. Pat. No. 4,919,847 (Colgate-Palmolive Company).

Next, the present invention will be explained in more detail by the following examples.

Washing Method

Forty eight liters of water at 20 degree C. are placed in a full automatic washing machine manufactured by National (NA45Y6). A methyl cellulose ether is placed in 500 ml of hot water in an amount such that the content of the methyl cellulose ether in 49 liters of water is 5 ppm. After stirring for 15 minutes, 500 ml of ion-exchanged water is added thereto and the methyl cellulose ether solution is cooled to 20 degree C. One liter of this methyl cellulose ether solution is added to 48 liters of water in the washing machine described above and stirred for 30 seconds.

Forty nine grams of a base detergent composition having the composition described hereinafter are added thereto, stirred for 15 seconds to make a state such that methyl cellulose ether-containing detergent composition is dissolved in washing water.

Thereafter, each test fabric is placed, laundered for 10–12 minutes, dehydrated for 3 minutes, (i) rinsed with 49 liters of stored water at 20 degree C., (ii) then rinsed for about 2–3 minutes, and (iii) thereafter dehydrated. The steps (i) through (iii) are repeated twice. Thereafter, the fabric is dried by means of a pressing machine.

Evaluation Method

Evaluation is carried out under an ultraviolet radiation-shielded light by three panelists skilled in the evaluation with the naked eye on a basis of the following nine scales. In Control, the same soils deposited on the same fabric are washed in the same manner as the washing manner except that no methyl cellulose ether is added:

+4: the soil is washed out better as compared with Control.

+3: the soil is washed out well as compared with Control.

+2: the soil is washed out apparently as compared with Control.

+1: it seems that the soil be washed out as compared with Control.

0: the same as Control.

−1: it seems that the soil is not washed out as compared with Control.

−2: the soil is not washed out apparently as compared with Control.

−3: little soil is washed out as compared with Control.

−4: the less soil is washed out as compared with Control.

Test Fabric

Washing prior to press drying (prewash) is repeated three times in the washing method described above, and each fabric is then dried. Each soil of muddy water or old motor oil is soaked into each fabric, and the muddy water-soaked fabric is spontaneously dried.

The fabrics A through C having the soil shown in Table 1 are prepared.

TABLE 1

| | Kind of fabric | Soil |
|---|---|---|
| A | 100% polyester | old motor oil |
| B | 100% polyester | mud |
| C | 100% polyester and 65% polyester-35% cotton blend | mud |

Base Detergent Composition

A detergent slurry is prepared from sodium $C_{12}$ linear alkylbenzene sulfonate, sodium $C_{14-15}$ alkyl sulfate and an acrylic acid-maleic acid copolymer and the slurry is then dried to form a base granule. Compaction and crushing-granulation are carried out. Thereafter, the base granule is mixed with $C_{12-14}$ polyoxyethylene alkyl ether, water, zeolite and a fluorescent brightener. Enzymes, bleaching components and the remaining components are added to the mixture to obtain a base detergent composition shown in the following Table 2.

If a detergent composition containing the methyl cellulose ether is prepared, the methyl cellulose ether can be added at the same time during the addition of the zeolite described above.

TABLE 2

| | % by weight |
|---|---|
| Surfactant | |
| Sodium $C_{12}$ linear alkylbenzene sulfonate | 19.6 |
| Sodium $C_{14-15}$ alkyl sulfate | 5.9 |
| $C_{12-14}$ polyoxyethylene alkyl ether | 3.0 |
| Tallow | 2.2 |
| Builder and Alkaline Material | |
| Acrylic acid-maleic acid copolymer (MW 6,500; molar ratio of acrylic acid to maleic acid = 70:30; BI = 100; DI = 100; IR = 100; ML-7 available from Nippon Shokubai) | 4.3 |
| Zeolite | 9.6 |
| Sodium carbonate | 23.9 |
| Sodium silicate | 12.5 |
| Bleaching Component | |
| Nonanoyloxybenzene sulfonate | 3.0 |
| Sodium perborate | 2.4 |
| Enzyme | |
| Protease (available from Novo Company under the trade name Savinase 12.0T) | 0.6 |
| Others | |
| Fluorescent brightener | 0.1 |
| Sodium sulfate | 4.8 |
| Polyethylene glycol (MW 4,000) | 0.5 |
| Polyvinyl pyrrolidone | 0.1 |
| Perfume | 0.2 |
| Antifoamer | 0.3 |
| Miscellaneous | 7.0 |
| Total | 100.0 |

In Table, BI, DI and IR are as described above.

EXAMPLE 1

Each methyl cellulose ether shown in the following table was used, and the test fabric was washed together with about 2.3 Kg of other laundry according to the washing method described above and dried.

The test fabric was evaluated according to the evaluation method described above. The results are shown in the following Table 3.

TABLE 3

| Methyl cellulose ether | | | Evaluation of test fabric | |
|---|---|---|---|---|
| Kind | Viscosity (cps) | Degree of methyl substitution | A | B |
| Metolose SM 100 | 80–120 | about 1.8 | 2.58 | 1.75 |
| Metolose SM 15 | 13–18 | about 1.8 | 0.91 | 1.92 |
| Metolose SM 200 | 160–240 | about 1.8 | 2.58 | — |
| Metolose SM 400 | 350–550 | about 1.8 | 2.66 | — |

The viscosity (cps) in Table represents a solution viscosity (centipoise=cps) measured at a temperature of 20 degree C. as a 2 wt % aqueous solution of the methyl cellulose ether. Metolose SM 15, Metolose SM 100, Metolose SM 200 and Metolose SM 400 are trade names of methyl cellulose ethers manufactured by Shin-etsu Kagaku Kogyo K.K.

EXAMPLE 2

Tests were carried out in the same manner as in Example 1 and fabrics were evaluated according to the evaluation method described above. The results are shown in the following Table 4.

TABLE 4

| | Methyl cellulose ether | | Evaluation of test fabric | |
|---|---|---|---|---|
| Kind | Viscosity (cps) | Degree of methyl substitution | E | C |
| Metolose SM 100 | 80–120 | 1.8 | 1.75 | 1.00 |
| Metolose SM 200 | 160–240 | 1.8 | −0.17 | 0.33 |

The viscosity (cps) in Table represents a solution viscosity (centipoise=cps) measured at a temperature of 20 degree C. as a 2 wt % aqueous solution of the methyl cellulose ether, and the degree of methyl substitution represents an average degree of methyl substitution per anhydroglucose. Metolose SM 100 and Metolose SM 200 are trade names of methyl cellulose ethers manufactured by Shin-etsu Kagaku Kogyo K.K.

As can be seen from Examples 1 and 2, when the high viscosity, i.e., high molecular weight (viscosity of from 160 to 240 cps and from 350 to 550 cps) methyl cellulose ethers are used in washing of the polyester fibers in washing water at not more than 30C in the presence of the methyl cellulose ethers, oily soil is sufficiently released and removed. However, muddy soil (particulate soil) is insufficiently released and removed. When low viscosity, i.e., low molecular weight (viscosity of from 13 to 18 cps) methyl cellulose ethers are used, muddy soil is sufficiently released and removed. However, oily soil is insufficiently released and removed. The detergent composition of the present invention (when the methyl cellulose ethers having a degree of methyl substitution of about 1.8 and a viscosity of from 80 to 120 are used) can release and remove oily soil and muddy soil very well at the same time.

Formulation

Other detergent compositions of the present invention are shown in Table 5.

TABLE 5

| | Sample No. 1 Amount (wt %) | Sample No. 2 Amount (wt %) | Sample No. 3 Amount (wt %) | Sample No. 4 Amount (wt %) | Sample No. 5 Amount (wt %) |
|---|---|---|---|---|---|
| Sodium $C_{12}$ linear alkylbenzene sulfonate | 30.0 | 30.0 | 25.0 | 25.0 | 27.0 |
| Sodium $C_{14-15}$ alkyl sulfate | 10.0 | 10.0 | 10.0 | 10.0 | 8.0 |
| $C_{12-14}$ polyoxyethylene alkyl ether | 3.0 | 3.0 | 2.0 | 3.0 | 3.0 |
| $C_{12}$ trimethyl ammonium chloride | — | — | 1.0 | — | — |
| Zeolite | 12.0 | 6.0 | 6.0 | 10.0 | 9.0 |
| Acrylic acid/maleic acid copolymer (MW 6,500; molar ratio of acrylic acid to maleic acid = 70:30; BI = 100, DI = 100, IR = 100; ML-7 available from Nippon Shokubai K.K.) | — | — | — | 6.0 | — |
| Acrylic acid/maleic acid copolymer (MW 11,000; molar ratio of acrylic acid to maleic acid = 60:40; BI = 122, DI = 122, IR = 149; OL-9 available from Nippon Shokubai K.K.) | 6.0 | 6.0 | 6.0 | — | 8.0 |
| SKS-6 (manufactured by Hoechst AG) | — | 24.0 | 10.0 | 10.0 | 12.0 |
| Polyethylene glycol (MW 4,000) | 1.0 | 1.0 | 1.0 | 1.0 | 1.0 |
| Sodium carbonate | 20.0 | 3.0 | 15.0 | 15.0 | 14.0 |
| Sodium silicate | 10.0 | — | — | — | — |
| Protease (available from Novo Company under the trade name Savinase 6.0T) | 3.0 | 2.0 | 3.0 | — | — |
| Protease (available from Novo Company under the trade name Savinase 12.0T) | — | — | — | 1.5 | 1.0 |
| Nonanoyloxybenzene sulfonate | — | 5.0 | 5.0 | 5.0 | 5.0 |
| Sodium percarbonate (manufactured by Tokai Denka Kogyo K.K.) | — | 5.0 | 10.0 | — | — |
| Sodium perborate monohydrate | — | — | 10.0 | 5.0 | 4.0 |
| Fluorescent brightener | 0.3 | 0.2 | 0.3 | 0.2 | 0.2 |
| Perfume | 0.4 | 0.3 | 0.4 | 0.3 | 0.3 |
| Metoldse SM 100 (manufactured by Shin-etsu Kagaku Kogyo K.K.) (methyl cellulose ether wherein its solution viscosity measured at a temperature of 20 C. as a 2 wt % aqueous solution is from 80 to 120 centipoises (cps) and the average degree of methyl substitution per anhydroglucose is from about 1.6 to 2.0) | 0.2 | 0.5 | 1.0 | 0.8 | 0.8 |
| Polyvinyl pyrrolidone (color migration inhibitor) | 0.5 | 0.3 | 0.5 | 0.3 | 0.3 |
| Suds suppressor | 0.5 | 0.3 | 0.5 | 0 | — |
| Soft silicon dioxide ($SiO_2$) | — | — | — | — | 0.4 |
| Miscellaneous | 3.1 | 3.4 | 3.3 | 6.9 | 6.0 |

In Table, BI, DI and IR are as described above.

As can be seen from the Examples described above, according to the present invention which provides a detergent composition for use in washing of polyester fibers comprising (i) from 0.05 to 2%. by weight of a methyl cellulose ether wherein its solution viscosity measured at a temperature of 20 degree C. as a 2 wt % aqueous solution is from 80 to 120 centipoises (cps) and its average degree of methyl substitution (DS methyl) per anhydroglucose is from about 1.6 to about 2.3;

(ii) from 25 to 65% by weight of a detergent surfactant;

(iii) from 0 to 20% by weight of a bleaching component; and (iv) from 30 to 70% by weight of a builder and an alkaline material, both oily soil and muddy soil (particulate soil) deposited on the polyester fibers are selectively and simultaneously released very well in washing water at not more than 30 degree C. and the polyester fibers can be effectively washed.

What is claimed is:

1. A detergent composition, comprising:

(i) from 0.05 to 2% by weight of methyl cellulose ether having a solution viscosity measured at a temperature of 20° C. as a 2% wt % aqueous solution of from 80 to 120 centipoises (cps) and an average degree of methyl substitution (DS methyl) per anhydroglucose of from about 1.6 to about 2.3, the methyl cellulose ether being of the formula

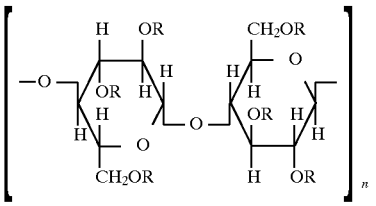

wherein each R individually represents a hydrogen atom or a methyl group, and n represents a degree of polymerization and is a value sufficient to provide said solution viscosity;

(ii) from 25 to 65% by weight of detergent surfactant;

(iii) from 0 to 20% by weight of bleaching component; and (iv) from 30 to 70% by weight of builder and alkaline material.

2. A detergent composition according to claim 1, wherein the solution viscosity of the methyl cellulose ether measured at a temperature of 20° C. as a 2 wt % aqueous solution is from 90 to 110 centipoises (cps) and the average degree of methyl substitution (DS methyl) per anhydroglucose of the methyl cellulose ether is from about 1.7 to about 1.9.

3. A detergent composition according to claim 2 wherein the detergent surfactant comprises a mixture of an anionic surfactant and a nonionic surfactant in a weight ratio of the anionic surfactant to the nonionic surfactant of from 50:50 to 95:5.

4. A detergent composition according to claim 3 wherein the anionic surfactant comprises a mixture of a linear alkylbenzene sulfonate and an alkyl sulfate in a weight ratio of the alkylbenzene sulfonate to the alkyl sulfate of from 1:99 to 80:20.

5. A detergent composition according to claim 2 wherein the detergent surfactant is selected from the group consisting of anionic, nonionic and cationic surfactants, and mixtures thereof, the bleaching component is selected from the group consisting of sodium perborate monohydrate, sodium percarbonate, bleach precursors which form a peracid in a wash solution in the presence of $^{-}$OOH ions, peracids and mixtures thereof, and the builder and alkaline material are selected from the group consisting of sodium carbonate, sodium hydrogencarbonate, acrylic acid-maleic acid copolymers, zeolites, sodium silicate, crystalline layered sodium silicate and mixtures thereof.

6. A detergent composition according to claim 2 wherein the detergent surfactant comprises a mixture of an anionic surfactant, a nonionic surfactant and a cationic surfactant in which the content of the cationic surfactant in the mixture is not more than 5% by weight.

7. A detergent composition according to claim 1, wherein the solution viscosity of the methyl cellulose ether measured at a temperature of 20° C. as a 2 wt % aqueous solution is from 90 to 110 centipoises (cps).

8. A detergent composition according to claim 1 wherein the average degree of methyl substitution (DS methyl) per anhydroglucose of the methyl cellulose ether is from about 1.7 to about 1.9.

9. A detergent composition according to claim 1 wherein the average degree of methyl substitution (DS methyl) per anhydroglucose of the methyl cellulose ether is about 1.8.

10. A detergent composition according to claim 1, comprising from 31% to 65% by weight of the detergent surfactant.

11. A detergent composition according to claim 1, comprising from 39% to 70% by weight of the builder and the alkaline material.

12. A detergent composition according to claim 1, comprising from 5% to 20% by weight of the bleaching component.

13. A method of washing polyester fabric in cold water, comprising adding a detergent composition according to claim 1 to washing water at a temperature of not more than 30° C. and contacting the washing water with soiled polyester fabric.

14. A method according to claim 13 wherein the solution viscosity of the methyl cellulose ether of the detergent composition measured at a temperature of 20° C. as a 2 wt % aqueous solution is from 90 to 110 centipoise.

15. A method according to claim 14, wherein the average degree of methyl substitution per anhydroglucose of the methyl cellulose ether of the detergent composition is from about 1.7 to about 1.9.

16. A method according to claim 13 wherein the solution viscosity of the methyl cellulose ether of the detergent composition measured at a temperature of 20° C. as a 2 wt % aqueous solution is from 90 to 110 centipoise and the average degree of methyl substitution per anhydroglucose of the methyl cellulose ether is from about 1.7 to about 1.9.

17. A detergent composition, comprising:

(i) from 0.05 to 2 percent by weight of methyl cellulose ether having a solution viscosity measured at a temperature of 20° C. as a 2 wt % aqueous solution of from 90 to 110 centipoise and an average degree of methyl substitution per anhydroglucose of from about 1.7 to about 1.9, the methyl cellulose ether being of the formula:

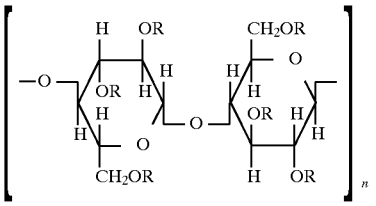

wherein each R individually represents a hydrogen atom or a methyl group, and n represents a degree of polymerization and is a value sufficient to provide said solution viscosity;

(ii) from 25 to 65% by weight of detergent surfactant comprising a mixture of an anionic surfactant and a nonionic surfactant in a weight ratio of anionic surfactant to nonionic surfactant of from 50:50 to 95:5, the anionic surfactant comprising a mixture of a linear alkyl benzene sulfonate and an alkyl sulfate in a weight ratio of from 1:99 to 80:20, and the detergent surfactant comprising not more than 5% by weight cationic surfactant;

(iii) from 0 to 20 percent by weight of bleaching component; and (iv) from 30 to 70 percent by weight of builder and alkaline material.

18. A detergent composition according to claim 17, wherein the average degree of methyl substitution per anhydroglucose of the methyl cellulose ether is about 1.8.

19. A detergent composition according to claim 17, comprising from 5 to 20 percent by weight of the bleaching component.

20. A detergent composition according to claim 17, further comprising at least one enzyme selected from the group consisting of protease, alkalase, cellulase and lipase.

* * * * *